US006705258B2

(12) United States Patent
Corse

(10) Patent No.: US 6,705,258 B2
(45) Date of Patent: Mar. 16, 2004

(54) VALVE SYSTEM FOR VARIABLE DISPLACEMENT DIESEL ENGINE

(76) Inventor: Mick Corse, 7353 Telegraph Rd., St. Louis, MO (US) 63129

( * ) Notice: Subject to any disclaimer, the term of this patent is extended or adjusted under 35 U.S.C. 154(b) by 0 days.

(21) Appl. No.: 10/078,571

(22) Filed: Feb. 20, 2002

(65) Prior Publication Data

US 2003/0154939 A1 Aug. 21, 2003

(51) Int. Cl.[7] ..... F01L 1/34

(52) U.S. Cl. ..... 123/90.16; 123/198 F; 123/90.15; 123/198 DB

(58) Field of Search ..... 123/90.1, 90.15, 123/90.16, 90.18, 90.31, 90.39, 198 F, 188.1, 188.2, 481, 198 DB; 180/219; 251/114

(56) References Cited

U.S. PATENT DOCUMENTS 4,204,512 A * 5/1980 Brock, Jr. ..... 123/198 F
5,329,895 A * 7/1994 Nishida et al. ..... 123/90.17
5,813,383 A * 9/1998 Cummings ..... 123/198 F
5,881,690 A * 3/1999 Park ..... 123/90.18
6,332,446 B1 * 12/2001 Matsumoto et al. ..... 123/198 F
6,431,154 B1 * 8/2002 Inoue ..... 123/481

* cited by examiner

*Primary Examiner*—Thomas Denion
*Assistant Examiner*—Kyle Riddle
(74) *Attorney, Agent, or Firm*—Henry W. Cummings

(57) ABSTRACT

A fuel valve is provided in the Diesel fuel supply line to a cylinder to be deactivated. A return fuel line is provided and when the fuel valve is open, the fuel is returned to the fuel supply tank. In closed position fuel is directed to the top portion of the cylinder. The cylinder is provided with a conventional exhaust valve. However, the intake valve is modified to be located closer to the top of the cylinder. The previous gap of about ¼ inch is reduced to about 0.005 to 0.015 inches. This allows the intake valve to remain open instead of closed as the piston moves upwardly in a deactivated cylinder when the exhaust valve is closed, to allow air to exit through the intake valve from the cylinder and relieve pressure when the piston is in the full up position. This valve system may be located in all Diesel engines including Diesel powered motorcycles.

8 Claims, 5 Drawing Sheets

VALVE SYSTEM FOR VARIABLE DISPLACEMENT DIESEL ENGINE

I FIELD OF THE INVENTION

This invention relates to an improved valve system for a variable displacement Diesel engine.

II BACKGROUND OF THE INVENTION

U.S. Pat. No. 5,813,383 discloses a variable displacement Diesel engine for use in automotive, overland truck, locomotive, marine and industrial applications in which selected cylinders are deactivated and reactivated depending on the load that the engine encounters. The system is preferably computer controlled. If a deactivated cylinder is below the minimum temperature for combustion at the time of reactivation, the glow plugs are activated to bring the cylinder up to the temperature necessary for combustion.

III SUMMARY OF THE INVENTION

A. Objects of the Invention

One object of the present invention is to provide an improved valve system for variable displacement Diesel engines.

Another object of the present invention is to provide a valve system for motorcycle Diesel engines.

Other objects will be apparent from the following Description and Drawings.

B. Summary

In accordance with the present invention a supply valve 15 is provided in the Diesel fuel supply line 14 to a cylinder to be deactivated. A return fuel line 16 is provided. When the supply valve is open, the fuel is returned to the fuel supply tank 18. In closed position fuel is directed to the top portion of the cylinder. The cylinder is provided with a conventional exhaust valve 24. However, the intake valve 30 is modified to be located closer to the top 22 of the cylinder. The previous gap 31 (FIG. 2) of about ¼ inch is reduced to about 0.005 to 0.015 inches as indicated at 33 in FIG. 3. This allows the intake valve to remain partially open instead of closed as the piston moves upwardly in the deactivated cylinder. Thus when the exhaust valve is closed, the intake valve allows air to exit from the cylinder when the exhaust valve is in the full up position of the piston. This arrangement thus avoids heat and exhaust products from non-deactivated cylinders from burning the modified intake valve. The modified intake valve is preferably operated by a cam to move the modified intake valve back and forth. The supply valve in the fuel line may be manually operated or computer controlled. This valve system is well adapted to large and small Diesel engines including motorcycle Diesel engines.

IV DRAWING DESCRIPTION

V DETAILED DESCRIPTION

Figure 1:
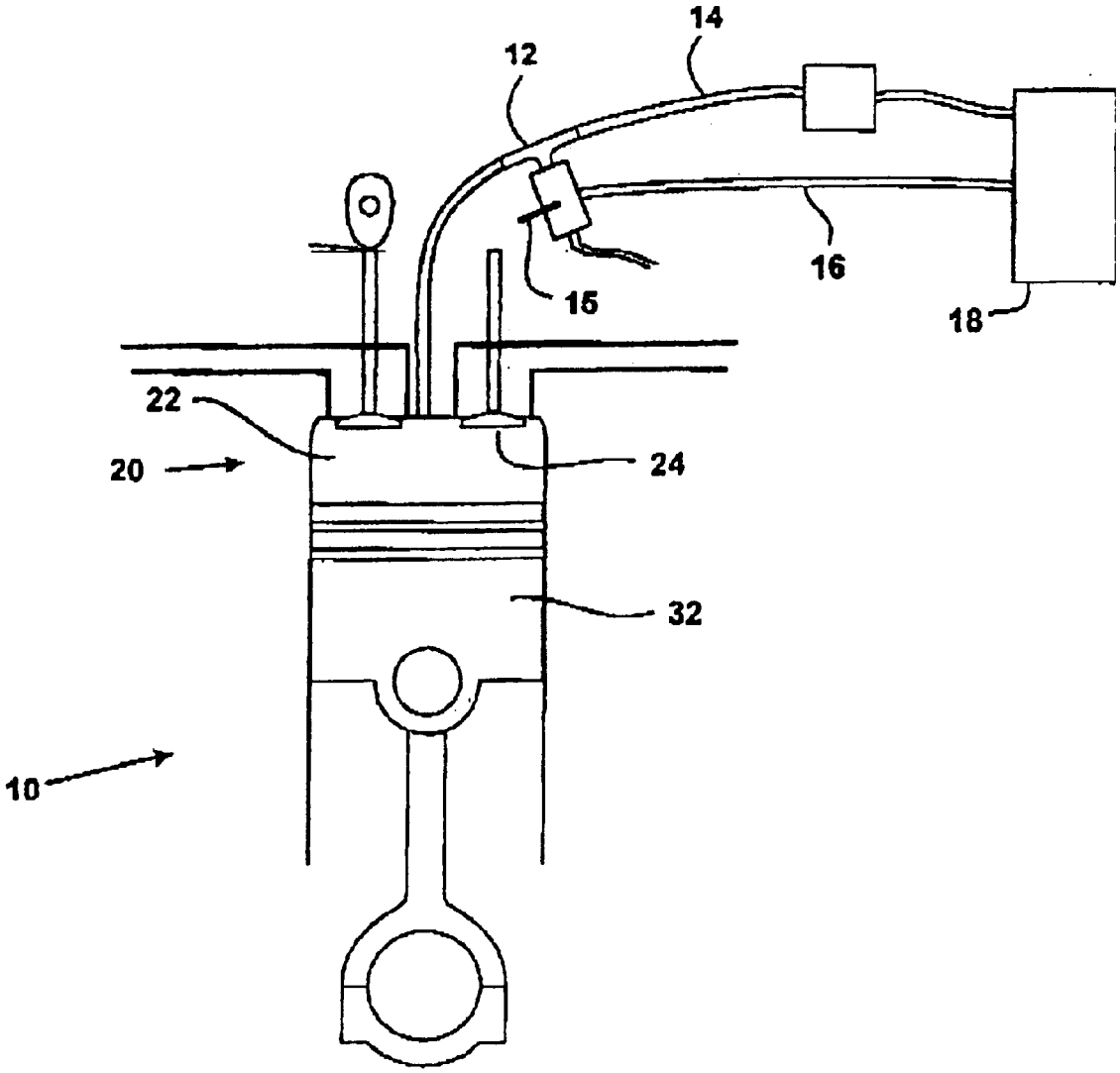
FIG. 1 is a schematic side elevation view of a Diesel engine cylinder with a conventional prior art intake and exhaust valve construction.

In accordance with the present invention in a variable displacement Diesel engine 10, a supply valve 12 is provided in the Diesel fuel supply line 14 to a cylinder 20 to be deactivated. The supply valve 12 in the fuel line may be a conventional lever operated ball valve or other manually operated valve with a handle 15 or be computer controlled in a manner described in U.S. Pat. No. 5,813,383 hereby incorporated into the present application by this reference, as fully set forth herein. A return fuel line 16 is provided. When the supply valve 12 is in open position the fuel is returned to a fuel supply tank 18. In closed position fuel is directed through line 14 to the top portion 22 of the cylinder 20.

The cylinder 20 is provided with a conventional exhaust valve 24.

Figure 2:
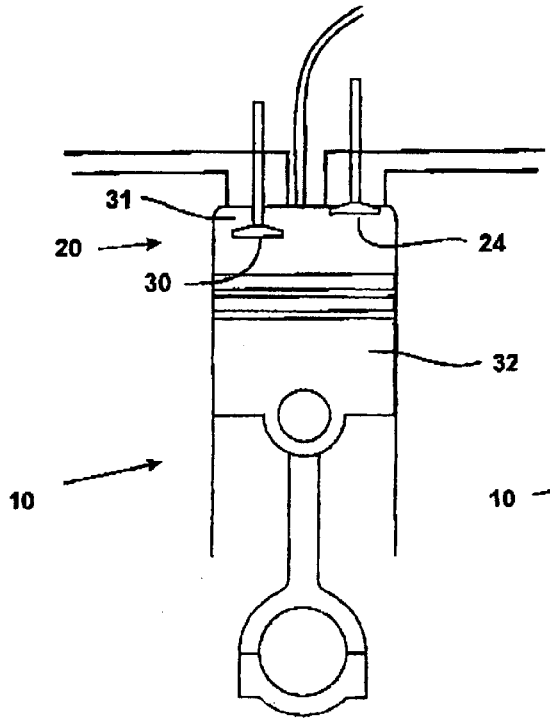
FIG. 2 is a partial side elevation view of a the Diesel engine cylinder in FIG. 1 showing the conventional intake valve and gap in open position.
Figure 3:
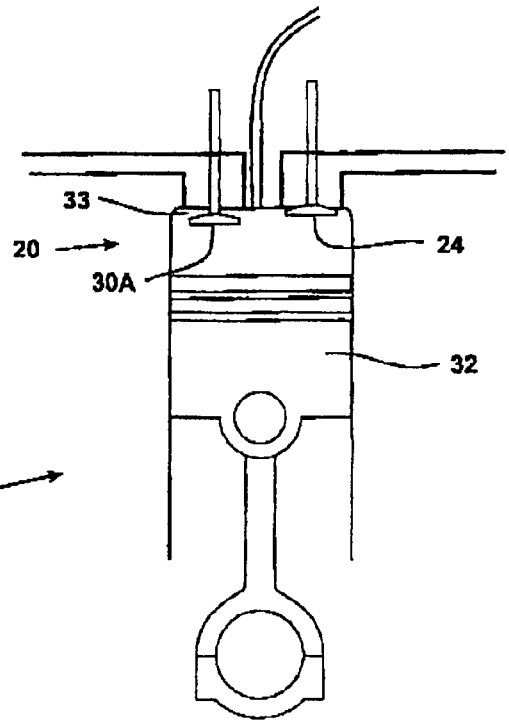
FIG. 3 is a schematic side elevation view of a Diesel engine cylinder with the improved intake valve construction with a smaller gap in accordance with the present invention.

However, the intake valve 30 shown in open position in FIG. 2 is modified from the closed position location shown in FIG. 1 to be located spaced from the top 22 of the cylinder 20 as shown in FIG. 3 at 30A. The gap 31 of about ¼ inch shown in FIG. 2 is reduced to about 0.005 to 0.015 inches as indicated at 33 in FIG. 3.

This allows the intake valve 30A to remain open instead of closed as the piston 32 moves upwardly in a deactivated cylinder 20, when valve 12 has been activated to return diesel fuel to supply tank 18. When the exhaust valve 24 is closed, the intake valve 30A allows air to exit from the cylinder and relieve pressure when the piston is in the full up position.

Figure 4:
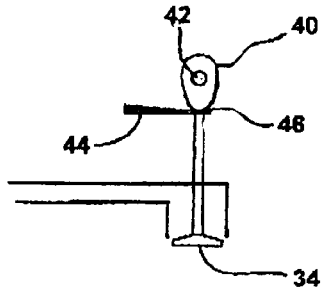
FIG. 4 is a schematic side elevation view of the improved intake valve cam control construction.

As shown in FIG. 4, the modified intake valve 30A is preferably operated by a cam 40 movable about a cam shaft 42, which engages a removable wedge 44 having a taper 46 to move the modified intake valve 30A back and forth.

Figure 5:
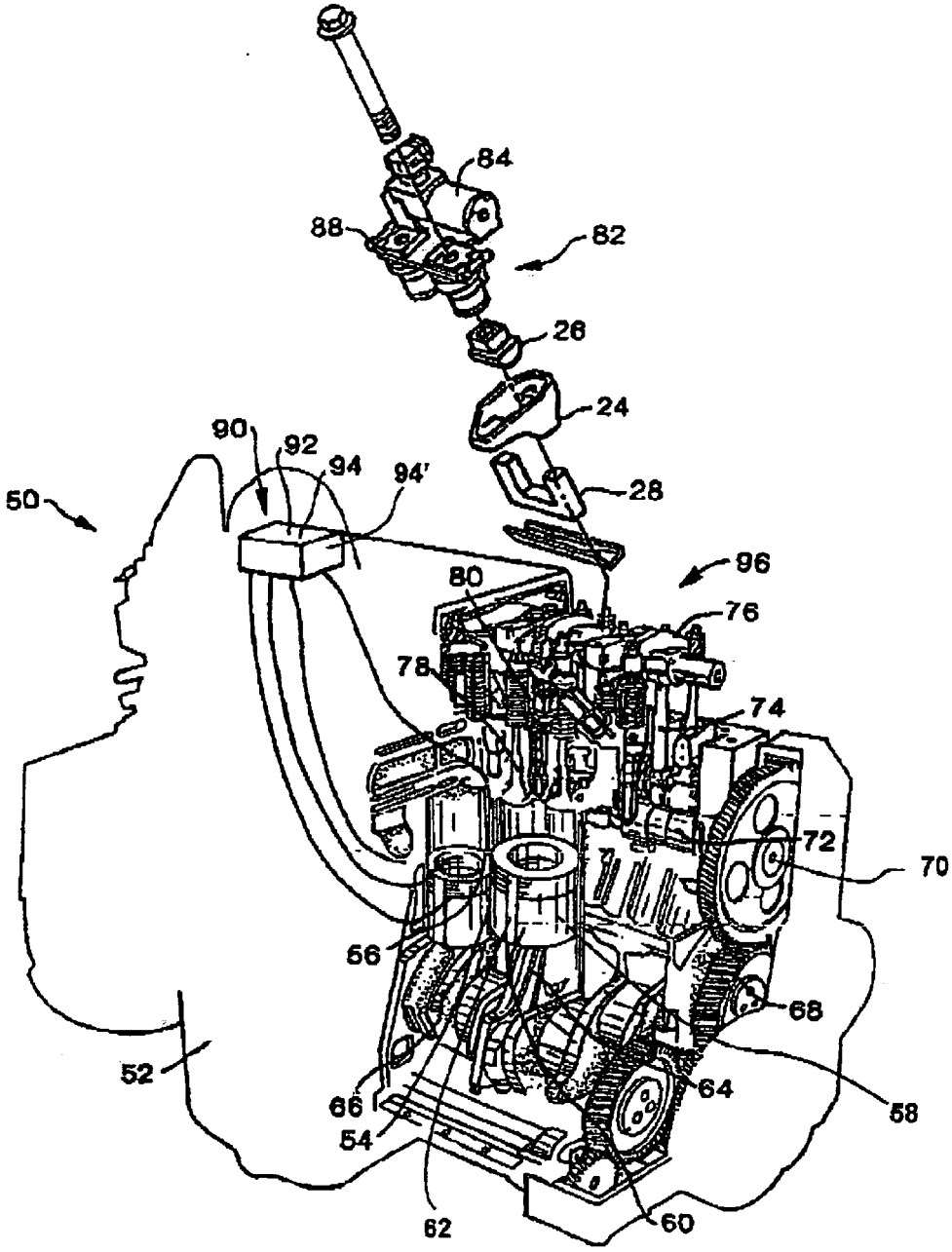
FIG. 5 is a perspective view of a variable displacement Diesel engine.

FIG. 5 illustrates an in-line computer controlled Cummins Diesel six cylinder M11 engine 50 including a high strength cylinder block 52 having cylinders 54 having cylinder liners 56 receiving pistons 58 with rings 60 having ring inserts 62.

The pistons 58 are connected to connecting rods 64 which are in-turn connected to an induction hardened crank shaft 66. A gear train 68 drives a cam shaft 70 having lobes 72 which control movement of push rods 74 which pivot rocker arms 76 to move valve stem 78, and open and close valves 80.

Two or more valve selectors 82 constructed in the same manner described in U.S. Pat. No. 5,813,383 including a solenoid valve 84, actuating a piston and a blocking plate 88, appropriately dimensioned for the M11 engine are then installed to deactivate two or three cylinders under low or moderate load conditions when the transmission is in high and/or overdrive gear under the control of the CELECT Plus computer 90 whose program 92 is modified to include a deactivation-activation program 94 to control deactivation and activation of selected cylinders 54, and control operation of glow plugs.

Alternatively the valve selector operation described in U.S. Pat. Nos. 4,546,734 and/or 4,615,307 may be utilized under the control of computer 90 and a deactivation-activation program 94' may be used.

Figure 6:
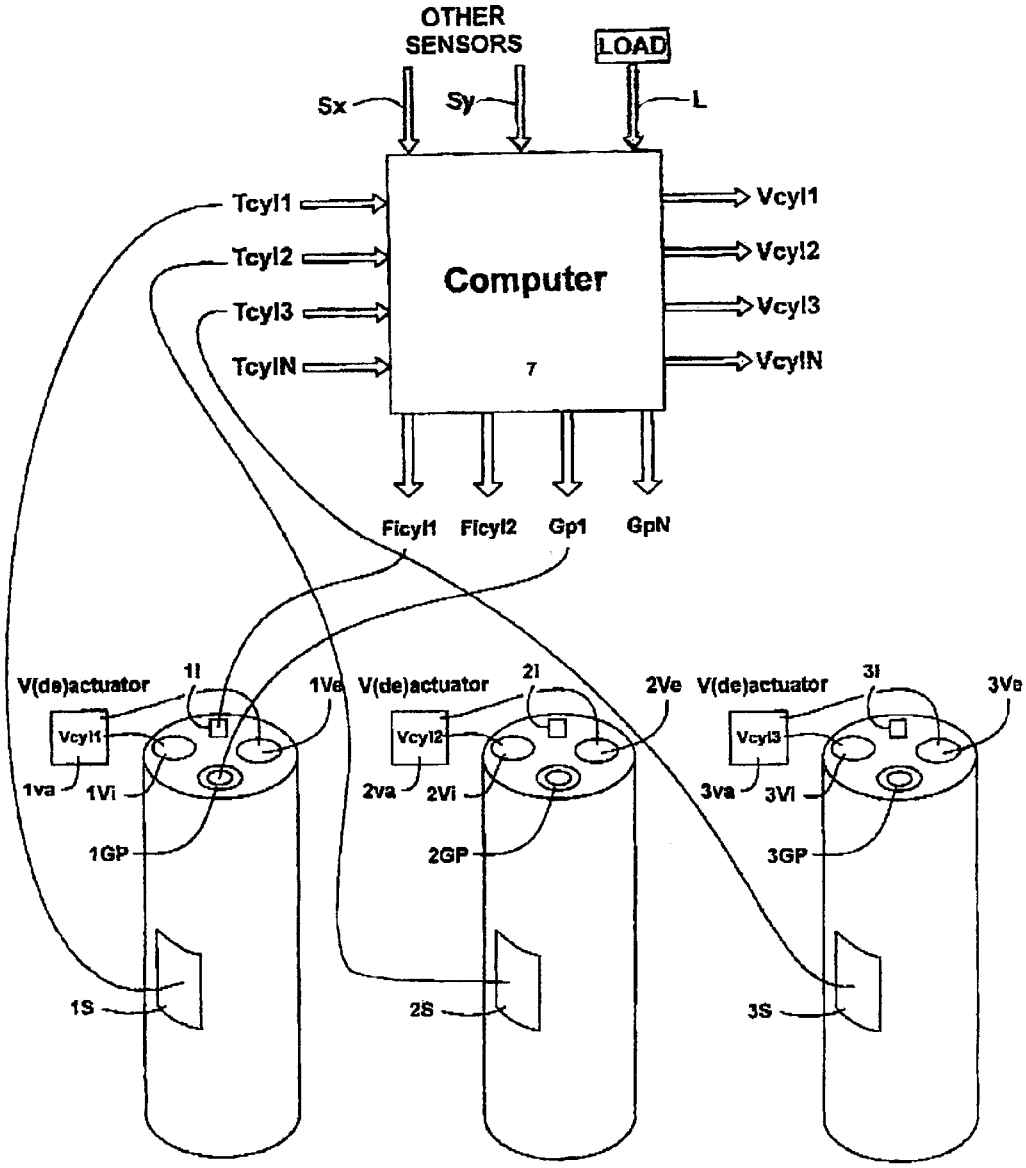
FIG. 6 is a schematic elevation view of a variable displacement valve control system.

FIG. 6 illustrates a computer 7 controlling cylinders 1, 2, 3 in an N cylinder Diesel engine with the sensors 1*s*, 2*s*, 3*s*, glow plugs 1GP, 2GP, and 3GP, injectors 1I, 2I, 3I, intake valves 1Vi, 2Vi, 3Vi, exhaust valves 1Ve, 2Ve, 3Ve, and valve actuators/deactivators 1*va*, 2*va*, 3*va*, for all cylinders. The computer 7 receives the cylinder temperatures from Sensors 1S, 2S, 3S, the Load L from a load sensor Ls, data from other Sensors Sx, Sy, and computes which cylinders should be deactivated and activated, and if the cylinders have glow plugs, when the glow plugs of the various cylinders are to be activated. The computer then sends electrical signals to the Valve Actuator/Deactivators, 1*va*, 2*va*, 3*va*, optional Glow Plugs 1GP, 2GP, 3GP, and fuel injectors 1I, 2I, 3I, to activate and deactivate various cylinders, depending on the load, the temperature of the individual cylinders, and other commonly computer controlled variables. The computer as an example may be the Electronic Diesel Control (EDC) processing unit described in DIESEL FUEL INJECTION, Bosh, 1994 EREF TJ 797 D55, pp 186–191.

Figure 7:
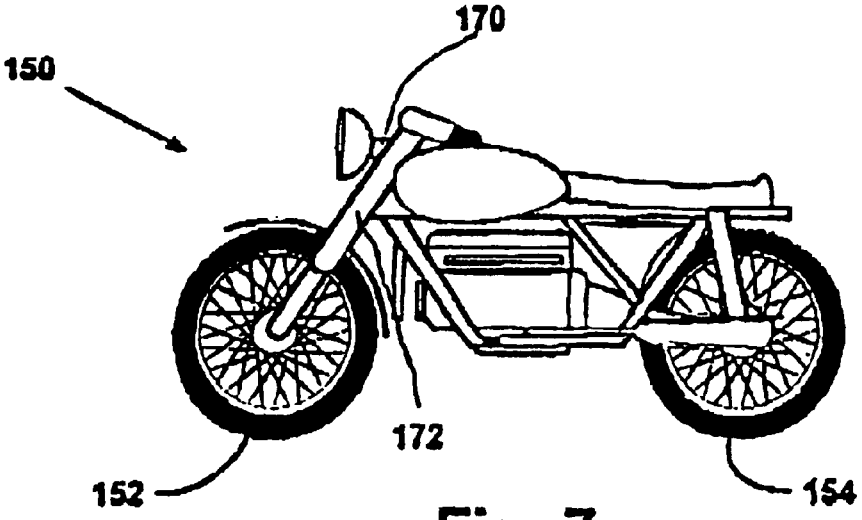
FIG. 7 is a schematic side elevation view of a motorcycle having a variable displacement Diesel engine with the improved intake valve construction, but not shown.
Figure 8:
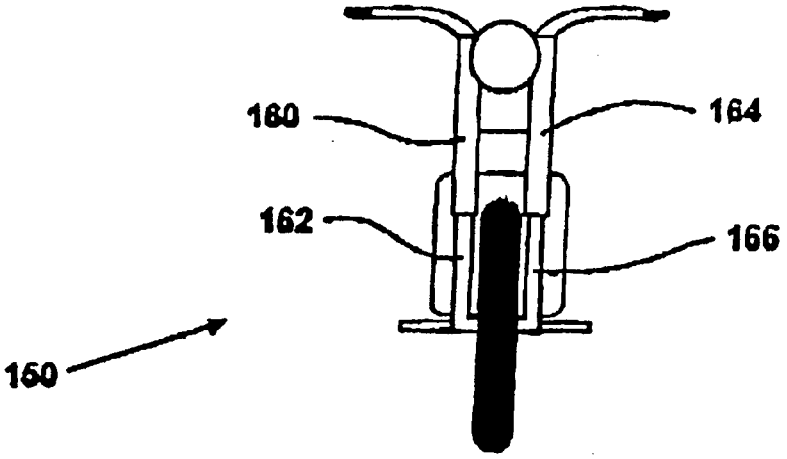
FIG. 8 is a schematic front elevation view of a motorcycle with the improved intake valve construction, but not shown.

In FIGS. 7 and 8 a motorcycle 150 includes wheels 152 and 154, and a telescoping front end 160, 162, 164 and 166. A top triple clamp 170 and a lower triple clamp 172 are also provided.

What is claimed is:

1. An improved variable displacement Diesel engine comprising:

a supply valve located in a Diesel fuel supply line to a cylinder to be deactivated;

a return fuel line to carry fuel when said supply valve is in a first position for fuel to be returned to the fuel supply tank;

said supply valve having a second position in which fuel is directed to a top portion of said cylinder;

said cylinder having a piston, an intake valve and an exhaust valve;

said intake valve defining a gap of about 0.005 to 0.015 inches located close to the top of said cylinder, whereby as said piston moves upwardly in said cylinder said intake valve remains open to allow air to exit through said intake valve, and when said piston is in the full up position in said cylinder when the exhaust valve is closed, said intake valve allows air to exit from the cylinder and relieve pressure when the piston is in the full up position.

2. An improved variable displacement Diesel engine according to claim 1 wherein said intake valve is operated by a cam movable about a cam shaft.

3. An improved variable displacement Diesel engine according to claim 2 wherein said cam engages a wedge to move said intake valve shaft back and forth.

4. An improved variable displacement Diesel engine according to claim 3 wherein said wedge has a taper.

5. In a motorcycle including:

longitudinally spaced wheels;

a telescoping front end;

a top triple clamp and a lower triple clamp; the improvement comprising:

an improved variable displacement Diesel engine comprising:

a supply valve located in a Diesel fuel supply line to a cylinder to be deactivated;

a return fuel line to carry fuel when said supply valve is in a first position for fuel to be returned to the fuel supply tank;

said supply valve having a second position in which fuel is directed to a top portion of said cylinder;

said cylinder having a piston, an intake valve and an exhaust valve;

said intake valve defining a gap about 0.005 to 0.015 inches located close to the top of said cylinder, whereby as said piston moves upwardly in said cylinder, said intake valve remains open to allow air to exit through said intake valve, and when said piston is in the full up position in said cylinder and said exhaust valve is closed, said intake valve allows air to exit from the cylinder and relieve pressure.

6. An improved motorcycle according to claim 5 wherein said intake valve is operated by a cam movable about a cam shaft.

7. An improved motorcycle according to claim 6 wherein said cam engages a wedge to move said intake valve shaft back and forth.

8. An improved motorcycle according to claim 7 wherein said wedge has a taper.

* * * * *